US005271119A

United States Patent [19]

Myers et al.

[11] Patent Number: 5,271,119

[45] Date of Patent: Dec. 21, 1993

[54] COMBINATION PROTECTIVE SHIELD AND METAL CAPTURE APPARATUS

[76] Inventors: Thomas G. Myers, 2852-C2 Walnut Ave., Tustin, Calif. 92680; Laura H. Dexter, 1260 S. Lyon, Santa Ana, Calif. 92705

[21] Appl. No.: 997,095

[22] Filed: Dec. 29, 1992

[51] Int. Cl.[5] ..... A47L 9/00

[52] U.S. Cl. ..... 15/246; 15/246.2; 15/339; 209/215

[58] Field of Search ..... 15/246, 246.2, 325, 15/339; 209/215

[56] References Cited

U.S. PATENT DOCUMENTS

| | | | |
|---|---|---|---|
| 2,288,115 | 6/1942 | Soldanels | 209/215 |
| 2,677,461 | 5/1954 | Bodey | 209/215 |
| 2,847,084 | 8/1958 | Wolfskill et al. | 15/339 |
| 3,206,783 | 9/1965 | Schwarz | 15/246 |
| 4,006,512 | 2/1977 | Saulson | 15/339 |
| 4,279,745 | 7/1981 | Haase | 209/215 |
| 4,300,260 | 11/1981 | Hill | 15/339 |
| 4,598,439 | 7/1986 | Good | 15/339 |
| 4,759,095 | 7/1988 | Hoy, Jr. | 15/339 |
| 4,797,968 | 1/1989 | Wenzlick et al. | 15/246 |
| 4,831,682 | 5/1989 | White | 15/325 |
| 4,876,762 | 10/1989 | Foster | 15/247 |
| 4,904,376 | 2/1990 | Haase | 15/339 |
| 4,947,506 | 8/1990 | Foster | 15/247 |
| 5,052,074 | 10/1991 | Korsen | 15/339 |
| 5,136,747 | 8/1992 | McCuaghan et al. | 15/247 |
| 5,179,756 | 1/1993 | Korsen | 15/246.2 |

*Primary Examiner*—Harvey C. Hornsby
*Assistant Examiner*—Mark Spisich

[57] ABSTRACT

An apparatus is provided for protectively covering a floor appliance, such as a vacuum cleaner. Such a floor appliance includes a body section having a bottom surface, which is disposed adjacent to a floor when the appliance is in use, a top surface opposite the bottom surface, and a side surface between and connecting the top and bottom surfaces. The cover includes a removable bonnet that substantially covers the top and side surfaces of the body section. The bonnet absorbs abrasive forces, such as impact with furniture, walls, and the like. A retaining strap is further included with the cover for removably attaching the bonnet to the body section of the appliance. A pouch of soft material includes an interior space for encompassing a permanent magnet. The pouch is fixed to the bonnet in such a position that the pouch extends crosswise to the direction of motion of the appliance for positioning the permanent magnet parallel to and adjacent to the floor. The pouch precedes the bonnet as the appliance moves across the floor in a forward direction. As such, the permanent magnet is in close proximity to the floor and is able to attract iron containing objects as the appliance moves across the object. The object is thereby held by the magnet onto the pouch, whereby the object is prevented from damaging the appliance.

4 Claims, 1 Drawing Sheet

COMBINATION PROTECTIVE SHIELD AND METAL CAPTURE APPARATUS

FIELD OF THE INVENTION

This invention relates generally to protective covers for appliances, and, more particularly, to a combination protective cover and magnet.

BACKGROUND OF THE INVENTION

Protective covers for vacuum cleaners and similar appliances are well known in the prior art. For example, U.S. Pat. No. 4,947,506 to Foster on Aug. 14, 1990; U.S. Pat. No. 4,831,682 to White on May 23, 1989; and U.S. Pat. No. 5,136,747 to McCaughan et al. on Aug. 11, 1992, all teach such protective appliance covers. Such covers are primarily designed to protect walls, furniture, and the like from becoming damaged by aggressive contact with the appliance. At the same time, such covers protect the appliance from itself becoming damaged through forceful contact with such objects. However, appliances such as vacuum cleaners can become damaged by contact with objects other than walls, furniture, and the like. For example, small metallic objects, once introduced into such an appliance, can cause damage to the appliance. Such prior art protective covers make no provision for preventing small, metallic objects from damaging appliances.

Clearly, then, there is a need for a protective cover that protects the appliance from metallic objects which may lie in its path and may cause damage to the appliance. Such a needed device would also protect against damage caused by aggressive contact between such an appliance and walls, furniture, and like objects. Such a needed device would be readily fastened to and removed from the appliance, and would provide adjustable positioning means for allowing optimal spacing between the device and the floor. Such a needed device, further, would be inexpensive to manufacture, wash, and otherwise maintain. The present invention fulfills these needs and provides further related advantages.

SUMMARY OF THE INVENTION

The present invention is a protective cover for a floor appliance, such as a vacuum cleaner. Such a floor appliance includes a body section having a bottom surface, which is disposed adjacent to a floor when the appliance is in use, a top surface opposite the bottom surface, and a side surface between and connecting the top and bottom surfaces. The cover includes a removable bonnet means that substantially covers the top surface and the side surface of the body section. The bonnet means is capable of absorbing abrasive forces, such as impact with furniture, walls, and the like. A retaining mean, such as a retaining strap, is further included with the cover for removably attaching the bonnet means to the body section of the appliance. The retaining means holds the bonnet means at a fixed space relationship to the bottom surface of the body section of the appliance to establish a selected spacing between the bonnet means and the floor when the appliance is disposed on the floor.

A permanent magnet has a magnetic attractive force capable of attracting an iron containing object, such as a paper clip, or the like. A pouch of soft material includes an interior space for encompassing the magnet. The pouch is fixed to the bonnet means in such a position that the pouch extends crosswise to the direction of motion of the appliance for positioning the permanent magnet parallel to and adjacent to the floor. The pouch precedes the bonnet means as the appliance moves across the floor in a forward direction. As such, the permanent magnet is in close proximity to the floor and is able to attract the iron containing object as the appliance moves across the object. The object is thereby held by the magnet onto the pouch, whereby the object is prevented from damaging the appliance.

The present invention is a protective cover that protects the appliance from metallic objects which may lie in its path and may cause damage thereto. The present device also protects against damage caused by aggressive contact between the appliance and walls, furniture, and like obstructions. The protective cover of the present invention is readily fastened to and removed from the appliance, and provides adjustable positioning means for allowing optimal spacing between the cover and the floor. The present invention, further, is relatively easy to manufacture, wash, and otherwise maintain. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
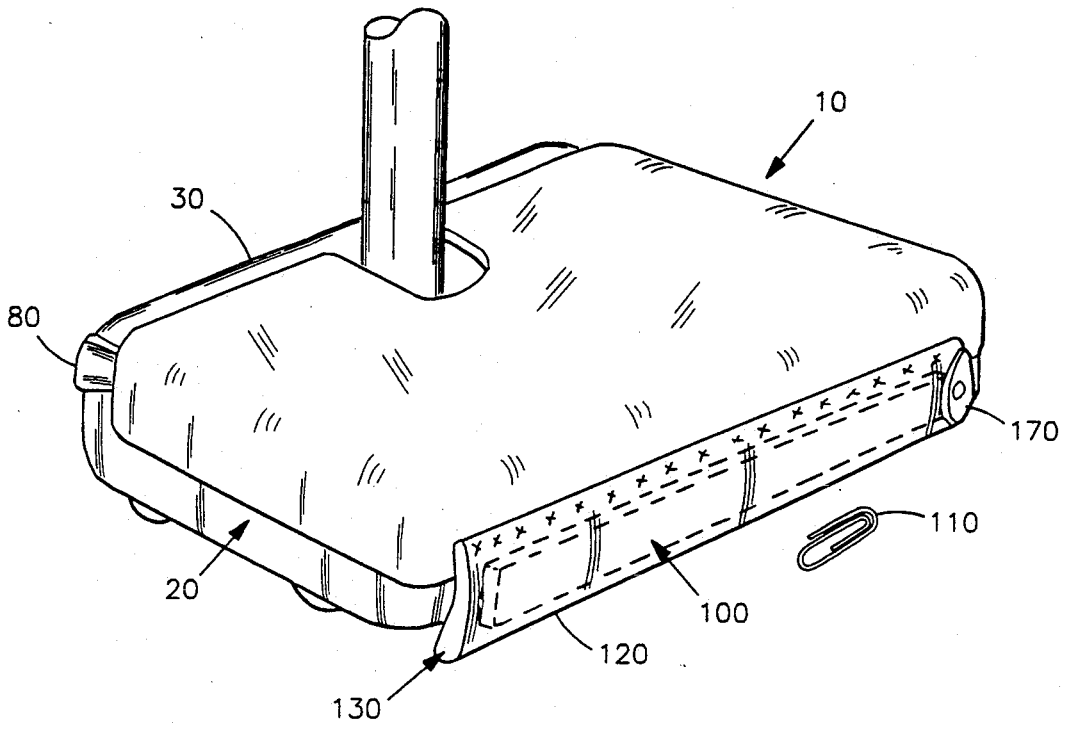
FIG. 1 is a perspective illustration of the invention, illustrating a protective cover of the invention as fastened to an appliance, such as a vacuum cleaner.
Figure 2:
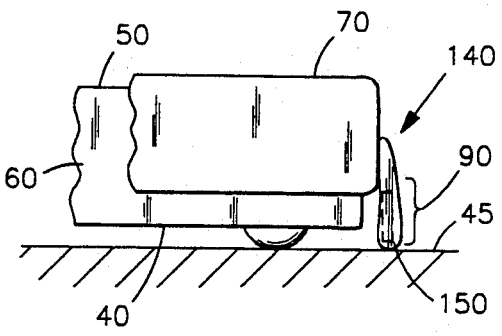
FIG. 2 is a partial right-side elevational view of the invention, illustrating a spacing between the floor and a magnet enclosed by a pouch of the invention.

FIG. 1 shows a protective cover 10 for a floor appliance 20, such as a vacuum cleaner. Such a floor appliance 20 includes a body section 30 having a bottom surface 40, which is disposed adjacent to a floor 45 when the appliance 20 is in use, a top surface 50 opposite the bottom surface 40, and a side surface 60 between and connecting the top surface 50 and the bottom surface 40. The cover 10 includes a removable bonnet means 70 that substantially covers the top surface 50 and the side surface 60 of the body section 30. The bonnet means 70 is capable of absorbing abrasive forces, such as impact with furniture, walls, and the like (not shown). Such a bonnet means 70 is preferably a padded fabric material. A retaining mean 80, such as a retaining strap, is further included with the cover 10 for removably attaching the bonnet means 70 to the body section 30 of the appliance 20. The retaining means 80 is capable of holding the bonnet means 70 at a fixed space relationship to the bottom surface 40 of the body section 30 of the appliance 20 to establish a selected spacing 90 between the bonnet means 70 and the floor 45 when the appliance 20 is disposed on the floor 45 (FIG. 2).

A permanent magnet 100 has a magnetic attractive force capable of attracting an iron containing object 110, such as a paper clip, or the like. A pouch 120 of soft material includes an interior space 130 for encompassing the magnet 100. The pouch 120 is fixed to the bonnet means 70 in such a position that the pouch 120 extends crosswise to the direction of motion of the appliance 20 for positioning the permanent magnet 100 parallel to and adjacent to the floor 45. The pouch 120 precedes the bonnet means 70 as the appliance 20 moves across the floor 45 in a forward direction. As such, the permanent magnet 100 is in close proximity to the floor 45 and is able to attract the iron containing object 110 as the appliance 20 moves across the object 110. The object 110 is thereby held by the magnet 100 onto the pouch 120 and prevented from damaging the appliance 20.

Figure 3:
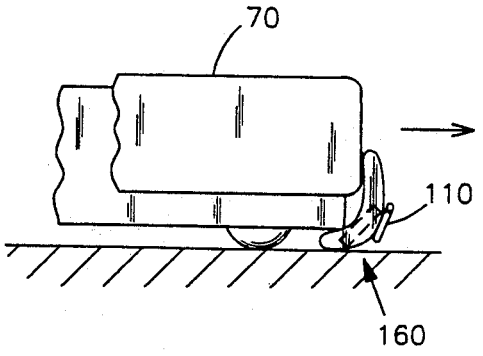
FIG. 3 is a partial right-side elevational view of the invention, illustrating the pouch of FIG. 2 in a rotated position such that the magnet of the invention is also rotated to maximize magnetic attraction between the magnet and objects on the floor.

Preferably, the pouch further includes an exterior surface 140 and is position on the bonnet means 70 such that at least one portion 150 of the exterior surface 140 is normally in contact with the floor 45 when the appliance is positioned on the floor 45. As such, the pouch 120 is forced to drag by the motion of the appliance 20 across the floor 45. As a result, the pouch 120 assumes a rotated position 160 and thereby allows the magnet 100 to be more fully and intimately disposed toward, and perhaps in contact with, the floor 45 (FIG. 3). The magnet 100, in such a rotated position, exerts more magnetic influence upon a metallic object 110 lying on the floor 45, and is therefore more effective at preventing such objects 110 from becoming introduced into the appliance 20. The protective cover 10 may be vertically adjusted such that the magnet 100, being fairly rigid, both captures metallic objects 110 and exerts a downward force upon non-metallic objects (not shown). As the magnet 100 passes over such non-metallic objects, such non-metallic objects tend to be flicked-up into the bottom surface 40 of the appliance 20, whereby they are more easily removed from the floor 45.

Preferably, the pouch 120 further includes a closure means 170, such as a flap covering an opening in the pouch 120, for locking the magnet 100 in place within the pouch 120. Such a closure means 170 may include a button, a zipper, Velcro ®, or many other conventional fastening means (not shown). As such, one may temporarily remove the magnet 100 in order to easily wash the protective cover 10.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A protective cover for a floor appliance adapted for movement across a floor including a body section having a bottom surface disposed adjacent the floor when the appliance is in use, a top surface opposite the bottom surface and a side surface between and connecting the top and the bottom surfaces, the apparatus comprising:

a bonnet for substantially covering the body section and being capable of absorbing abrasive forces;

a retaining means for removably attaching said bonnet to the body section of the appliance, said retaining means capable of holding said bonnet at a fixed space relationship to the bottom surface of the body section of the appliance to establish a selected spacing between the bonnet and the floor when the appliance is disposed on the floor;

a permanent magnet having a magnetic attractive force capable of attracting an iron containing object; and a pouch of soft material including an interior space for encompassing the permanent magnet, the pouch being fixed to the bonnet in such a position that the pouch extends crosswise to the direction of motion of the appliance for positioning the permanent magnet parallel to and adjacent the floor, the pouch preceding the bonnet as the appliance moves across the floor; whereby the permanent magnet, being in close proximity to the floor, is able to attract the iron containing object as the appliance moves across said object, the object thereby being held by the magnet onto the pouch.

2. The cover of claim 1 wherein the pouch further includes an exterior surface, the pouch being positioned on the bonnet such that at least one portion of the exterior surface is normally in contact with the floor when the appliance is positioned on the floor.

3. The cover of claim 1 wherein the pouch further includes an exterior surface, the pouch being positioned on the bonnet such that at least one portion of the exterior surface is normally in contact with the floor when the appliance is positioned on the floor, such that the pouch is forced to drag by the motion of the appliance across the floor, the pouch assuming a rotated position to allow the permanent magnet to be more fully and intimately in contact with the floor.

4. The cover of claim 1 wherein the pouch further includes a closure means for locking the permanent magnet in place within the pouch.

* * * * *